US008862024B2

(12) United States Patent
Kubo et al.

(10) Patent No.: US 8,862,024 B2
(45) Date of Patent: Oct. 14, 2014

(54) ATTACHABLE/DETACHABLE BODY AND IMAGE FORMING APPARATUS

(75) Inventors: Ryota Kubo, Kanagawa (JP); Taro Mitsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 409 days.

(21) Appl. No.: 13/207,613

(22) Filed: Aug. 11, 2011

(65) Prior Publication Data

US 2012/0051781 A1 Mar. 1, 2012

(30) Foreign Application Priority Data

Aug. 24, 2010 (JP) ..... 2010-186770

(51) Int. Cl.
*G03G 21/16* (2006.01)

(52) U.S. Cl.
USPC ..... 399/111; 399/237; 399/27; 399/109; 399/119

(58) Field of Classification Search
USPC ..... 399/111, 27, 90, 109, 258
See application file for complete search history.

(56) References Cited

U.S. PATENT DOCUMENTS

| | | | | |
|---|---|---|---|---|
| 6,055,406 | A * | 4/2000 | Kawai et al. | 399/360 |
| 2003/0123896 | A1 | 7/2003 | Goto et al. | |
| 2005/0135832 | A1 | 6/2005 | Kubota et al. | |
| 2006/0083555 | A1 * | 4/2006 | Uchiyama et al. | 399/258 |

FOREIGN PATENT DOCUMENTS

| | | | |
|---|---|---|---|
| JP | 2003-195726 | A | 7/2003 |
| JP | 2005-196144 | A | 7/2005 |

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

An attachable/detachable body includes a main body, a positioned portion, a transmitted member a contacting portion. The main body of the attachable/detachable body is supported to be attachable to and detachable from a main body of an image forming apparatus. The positioned portion is positioned at a positioning portion provided at the main body of the image forming apparatus. The transmitted member is connected to a transmission member provided at the main body of the image forming apparatus to transmit a drive thereto, the transmitted member transmitting the drive to a driven member provided at the main body of the attachable/detachable body. The contacting portion comes into contact with a contacted portion that is provided at the main body of the image forming apparatus to be connected electrically thereto.

9 Claims, 6 Drawing Sheets

ATTACHABLE/DETACHABLE BODY AND IMAGE FORMING APPARATUS

CROSS-REFERENCE TO RELATED APPLICATION

This application is based on and claims priority under 35 U.S.C. 119 from Japanese Patent Application No. 2010-186770 filed on Aug. 24, 2010.

BACKGROUND

1. Technical Field

The present invention relates to an attachable/detachable body and an image forming apparatus.

2. Related Art

Conventionally, in image forming apparatuses, such as a copying machine and a printer, in order to newly supply consumables, such as a developer, or to make a member worn out over time with use easily replaced or repaired, a replaceable unit is widely used.

SUMMARY

In order to address the above technical object, there is provided an attachable/detachable body according to an aspect of the invention including: a main body of the attachable/detachable body supported to be attachable to and detachable from a main body of an image forming apparatus; a positioned portion provided at the main body of the attachable/detachable body, and positioned at a positioning portion provided at the main body of the image forming apparatus when the main body of the attachable/detachable body is mounted on the main body of the image forming apparatus; a transmitted member that is provided at the main body of the attachable/detachable body, and is connected to a transmission member provided at the main body of the image forming apparatus to transmit a drive thereto, when the main body of the attachable/detachable body is mounted on the main body of the image forming apparatus, the transmitted member transmitting the drive to a driven member provided at the main body of the attachable/detachable body; and a contacting portion that is provided at the main body of the attachable/detachable body, and comes into contact with a contacted portion that is provided at the main body of the image forming apparatus to be connected electrically thereto, when the main body of the attachable/detachable body is mounted on the main body of the image forming apparatus, the contacting portion having at least a portion arranged on the side of the positioned portion of an extension of a straight line that passes through the positioned portion and the transmitted member.

BRIEF DESCRIPTION OF THE DRAWINGS

Exemplary embodiments of the present invention will be described in detail based on the following figures, wherein:

FIG. 4A is an explanatory view when the attachable/detachable body is viewed from the left-diagonal upper rear, and FIG. 4B is an explanatory view when the attachable/detachable body in the state of being mounted on the main body of the image forming apparatus is viewed from the rear.

FIG. 5A is an explanatory view of the principal parts in a state where the attachable/detachable body has been mounted on the main body of the image forming apparatus, and FIG. 5B is an explanatory view of the principal parts in a state where the attachable/detachable body has moved forward from the state shown in FIG. 5A.

DETAILED DESCRIPTION

Figure 1:
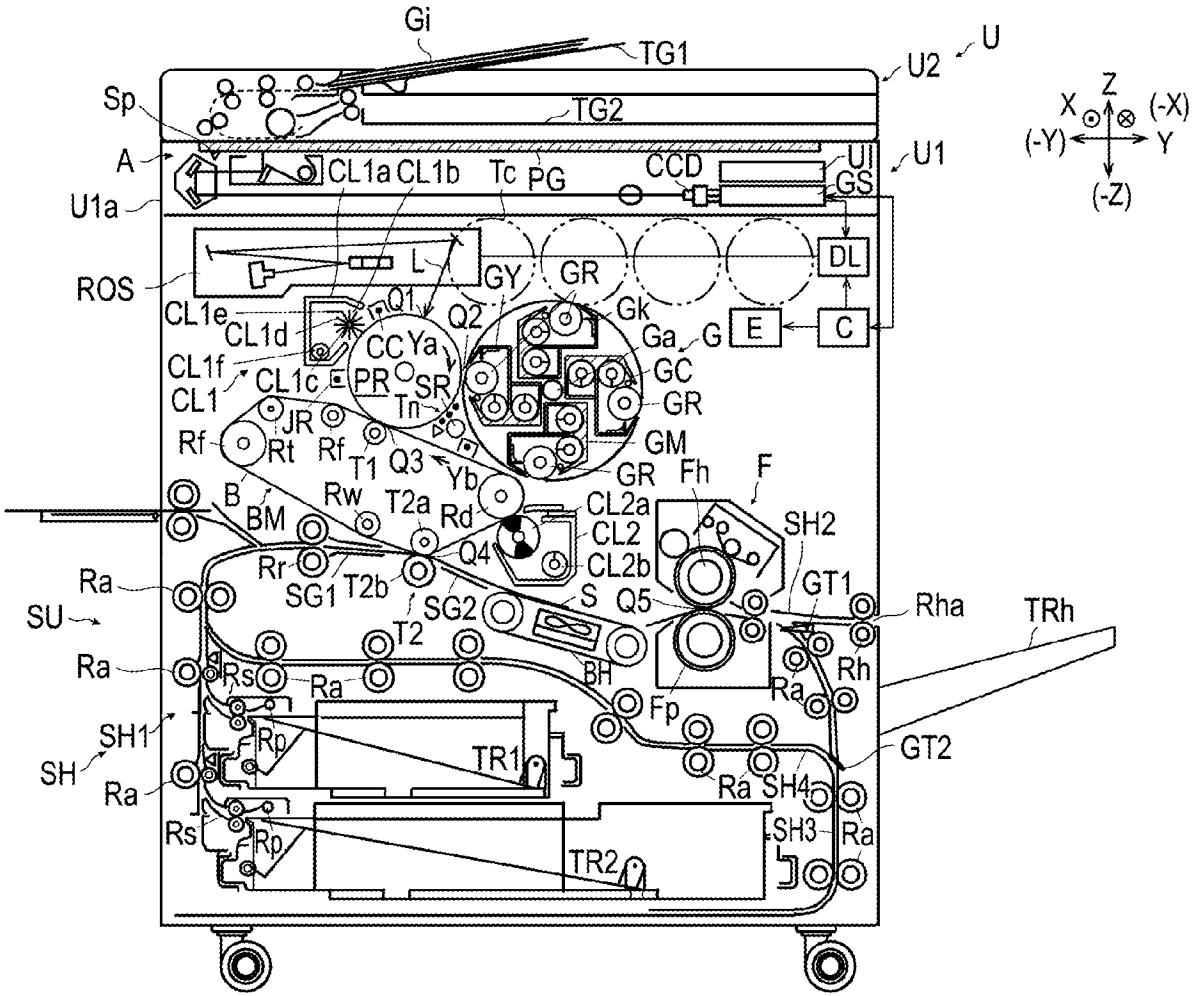
FIG. 1 is an explanatory view of the overall image forming apparatus of Example 1 of the invention.

Next, although specific examples (hereinafter referred to as examples) of an exemplary embodiment of the invention will be described referring to the drawings, the invention is not limited to the following examples.

In addition, in order to make the invention more easily understood, in the drawings, the front-and-rear direction is defined as the X-axis direction, the right-and-left direction is defined as the Y-axis direction, and the up-and-down direction is defined as the Z-axis direction. Additionally, directions or sides shown by arrows X, −X, Y, −Y, Z, and −Z are defined as the front direction, the rear direction, the right direction, the left direction, an up direction, and a down direction, respectively, or are defined as the front side, the rear side, the right side, the left side, the upper side, and the lower side, respectively.

Additionally, in the drawings, a symbol in which "•" is in "O" means an arrow that turns to the front of a sheet from the back thereof, and a symbol in which "X" is in "O" means an arrow that turns to the back of the sheet from the front thereof.

In addition, in the following description using the drawings, illustrations of other members than those required for description are appropriately omitted for ease of understanding.

EXAMPLE 1

FIG. 1 is an explanatory view of an overall image forming apparatus of Example 1 of the invention.

In FIG. 1, an image forming apparatus U of Example 1 is constituted by a copying machine. The image forming apparatus U has a main body U1 of the copying machine serving as an example of a main body of the image forming apparatus that has a platen glass PG serving as an example of a transparent document reading side at an upper end, and an automatic document conveying device U2 placed on the platen glass PG of the main body U1 of the copying machine. The automatic document conveying device U2 has a document feed tray TG1 on which plural copied documents Gi are loaded, as an example of a document feed section. The plural documents Gi loaded on the document feed tray TG1 is sequentially conveyed to a preset document reading position on the platen glass PG, and is ejected to a document ejection tray TG2 serving as an example of a document ejection section. A rear end portion of the automatic document conveying device U2 is supported so as to be rotatable with respect to the main body U1 of the copying machine by an opening and closing shaft (not shown) that extends in the right-and-left direction, and the automatic document conveying device U2 is turned upward when a document Gi is placed on the platen glass PG.

The main body U1 of the copying machine has a user interface UI serving as an example of a control section which allows a user to perform an input operation of an operation command.

A scanner section U1*a* serving as an example of a document reader is arranged below the platen glass PG of the upper surface of the main body U1 of the copying machine. The scanner section U1*a* has an exposure system registration sensor Sp arranged at a platen registration position serving as an example of an exposure reference position, and an exposure optical system A, as an example of a detecting member of an exposure system. The exposure optical system A is controlled in movement and stopped by a detection signal of the exposure system registration sensor Sp, and is always stopped at a home position serving as an example of an initial position. The reflected light from the document Gi that passes through the document reading position on the upper surface of the platen glass PG by the automatic document conveying device U2, or the reflected light from the document Gi manually placed on the platen glass PG is converted into electrical signals of R:red, G:green, and B:blue by an image sensor CCD via the exposure optical system A, and is input to an image processing section GS.

The image processing section GS converts the electrical signals of RGB input from the image sensor CCD into image data of K:black, Y:Yellow, M:magenta, and C:cyan serving as an example of the image information, temporarily stores the converted image data, and outputs the image data to a laser drive circuit DL serving as an example of a latent image formation drive circuit as image data for latent image formation at preset timing. The laser drive circuit DL outputs a driving signal to a latent image forming device ROS according to the input image data.

Figure 2:
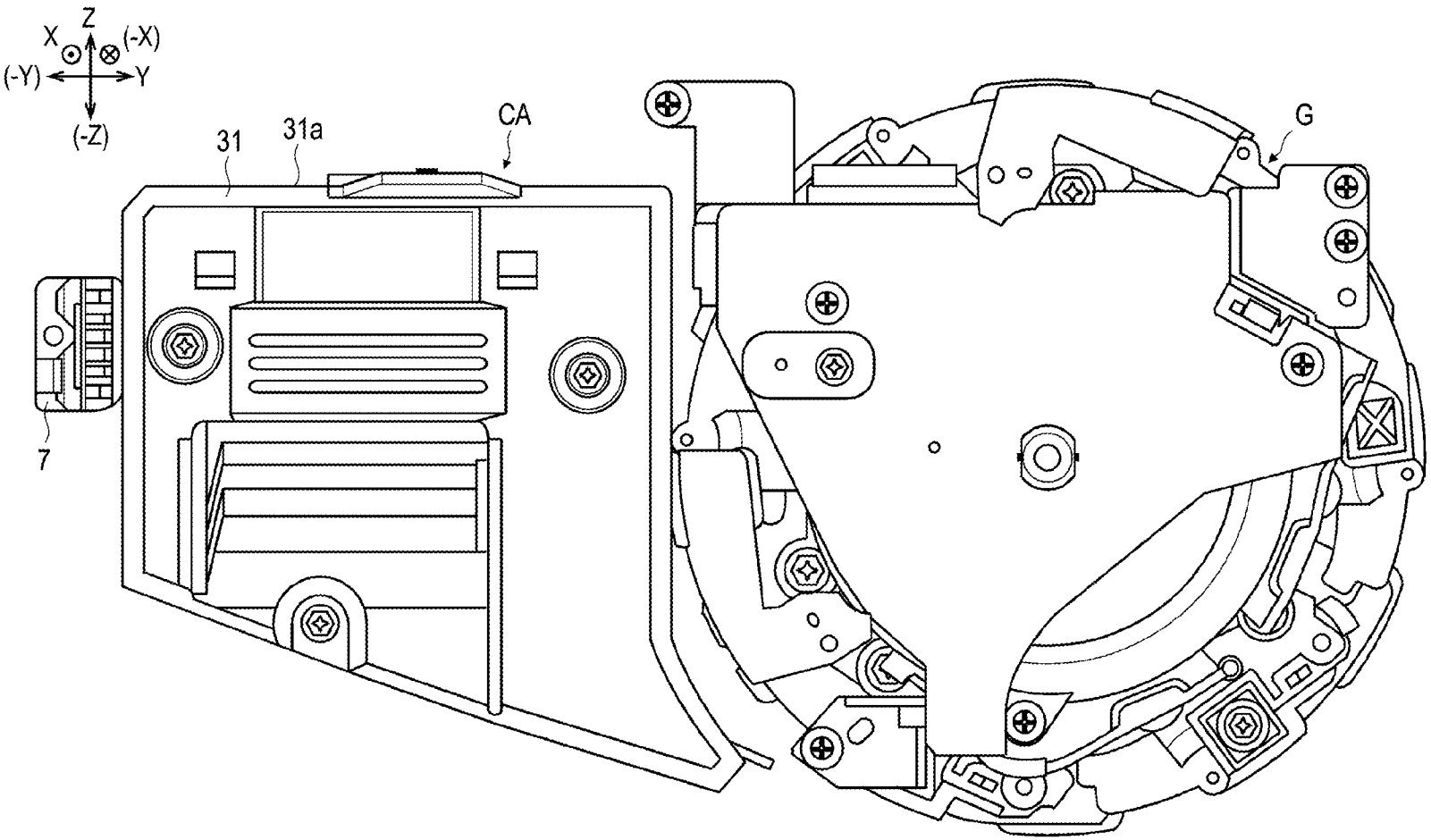
FIG. 2 is an enlarged explanatory view of the principal parts of an attachable/detachable body of Example 1 of the invention.

FIG. 2 is an enlarged explanatory view of the principal parts of an attachable/detachable body of Example 1 of the invention.

In FIGS. 1 and 2, a process cartridge CA serving as an example of the attachable/detachable body is detachably mounted below the latent image forming device ROS.

The process cartridge CA has a photoconductor drum PR serving as an example of an image carrier, a charger CC, and a photoconductor cleaner CL1 serving as an example of a driven member, which is an example of a cleaning device.

The photoconductor cleaner CL1 of Example 1 is an example of a receiving container, and has a cleaner container CL1*a* serving as an example of a cleaning container, and a cleaner brush CL1*b* serving as an example of a cleaning member, which is housed within the cleaner container CL1*a*, and rotates while facing and contacting the photoconductor drum PR. The cleaner brush CL1*b* has a shaft portion CL1*c* of the cleaner serving as an example of a shaft portion of the cleaning member, which is constituted by a conductive member extending in the front-and-rear direction, and brush bristles CL1*d* serving as an example of a bristle portion of the cleaning member, which is constituted by a conductive member extending outward in the radial direction of the shaft portion CL1*c* of the cleaner.

A plate-shaped scraper CL1*e* serving as an example of a flipping member is supported inside the cleaner container CL1*a* in a state where its tip has bitten into the cleaner brush CL1*b*, and flips the brush bristles CL1*d* of the cleaner brush CL1*b* to move developer adsorbed on the cleaner brush CL1*b* into the cleaner container CL1*a*. A conveying auger CL1*f* serving as an example of a conveying member that conveys the developer stored within the cleaner container CL1*a* is arranged below the scraper CL1*e*.

In FIG. 1, the photoconductor drum PR is rotating in the direction of an arrow Ya, and has a surface discharged by a discharger JR, uniformly charged by the charger CC, and then exposed and scanned at a latent image writing position Q1 with a laser beam L serving as an example of a latent image writing light of the latent image forming device ROS, thereby forming an electrostatic latent image. In a case where a color image serving as an example of a multicolor image is formed, electrostatic latent images corresponding to a four-color image of K:black, C:cyan, Y:yellow, and M:magenta are sequentially formed on the surface of the photoconductor drum PR, and in a case where a monochrome image serving as an example of a monochrome image is formed, only an electrostatic latent image corresponding to an image of K:black is formed on the surface of the photoconductor drum PR.

In FIG. 1, the surface of the photoconductor drum PR on which the electrostatic latent images are formed rotates to move, and passes through a developing region Q2 and a primary transfer region Q3 sequentially.

On the right of the photoconductor drum PR, a rotary developing device G serving as an example of a rotary developing device is arranged to face the photoconductor drum PR in the developing region Q2. The developing device G has four-color developing units GK, GY, GM, and GC of K:black, Y:yellow, M:magenta, and C:cyan, and the developing units GK, GY, GM, and GC rotate and move sequentially to the developing region Q2 with the rotation of a development rotating shaft Ga of the developing device G. The developing units GK, GY, GM, and GC have a developing roll GR serving as an example of a developer carrier that conveys developer to the developing region Q2, and develop the electrostatic latent images on the photoconductor drum PR that passes through the developing region Q2 into a toner image Tn serving as an example of a visible image. A new developer is supplied to each of the developing units GK, GY, GM, and GC from a toner cartridge Tc serving as an example of a developer storage container. Additionally, a seal roll SR serving as an example of a developer leakage preventing member that prevents a cloud-like floating toner, i.e., a so-called cloud-like toner, which is generated between the developing roll GR and the photoconductor drum PR in the developing region Q2, from leaking out to the main body U1 of the copying machine, is arranged on the downstream side of the developing region Q2 of the photoconductor drum PR.

In FIG. 1, a belt module BM serving as an example of an intermediate transfer device is arranged below the photoconductor drum PR. The belt module BM is an example of an intermediate transfer body, and has an intermediate transfer belt B serving as an example of a second rotating body. The intermediate transfer belt B is arranged to face the photoconductor drum PR in the primary transfer region Q3. The intermediate transfer belt B is rotatably and movably supported by a belt driving roll Rd serving as an example of a driving member of the intermediate transfer body, a tension roll Rt serving as an example of a stretching member of the intermediate transfer body, a walking roll Rw serving as an example of a meandering preventing member, a belt supporting roll (Rd, Rt, Rw, Rf, T2*a*) serving as an example of a supporting member of the intermediate transfer body including an idler roll Rf serving as an example of a driven member of the intermediate transfer body, and a back up roll T2*a* serving as an example of a secondary transfer facing member, and a primary transfer roller T1 serving as an example of a primary transfer member.

The belt module BM of Example 1 is constituted by the intermediate transfer belt B, the belt driving roll Rd, the tension roll Rt, the walking roll Rw, the idler roll Rf, the back up roll T2*a*, and the primary transfer roller T1.

In a case where a color image is formed, an electrostatic latent image of a first color is formed at the latent image writing position Q1, and a toner image Tn of the first color is formed at the developing region Q2. When this toner image Tn passes through the primary transfer region Q3, the toner image is primarily transferred onto the intermediate transfer belt B by the primary transfer roller T1. Thereafter, similarly, primary toner images Tn of a second color, a third color, and a fourth color are sequentially and overlappingly transferred onto the intermediate transfer belt B to which the toner image Tn of the first color has been transferred, thereby eventually forming a color multi-toner image on the intermediate transfer belt B. In a case where a monochrome image color is formed, only black developing unit GK is used, and a monochromatic toner image is primarily transferred onto the intermediate transfer belt B. After the primary transfer, the surface of the photoconductor drum PR is discharged by the discharger JR, and is cleaned by the photoconductor cleaner CL1.

In FIG. 1, a secondary transfer roller T2*b* serving as an example of a secondary transfer member is disposed below the back up roll T2*a* so as to be movable between a position where the secondary transfer roller is spaced apart from the back up roll T2*a*, and a position where the secondary transfer roller is brought into contact with the back up roll. Additionally, a secondary transfer region Q4 is formed by a contact region between the back up roll T2*a* and the secondary transfer roller T2*b*. A secondary transfer voltage having a polarity opposite to the charging polarity of the toner used in the developing device G is supplied to the back up roll T2*a* from a power circuit E, and the power circuit E is an example of a read-out member, and is controlled by a controller C serving as an example of a control section. A secondary transfer unit T2 of Example 1 serving as an example of a transfer unit is constituted by the back up roll T2*a* and the secondary transfer roller T2*b*.

A recording sheet S serving as an example of a medium stored in sheet feed trays TR1 and TR2 serving as an example of a medium feed section, is taken out at a preset timing by a pickup roll Rp serving as an example of a medium take-out member, is separated one by one by a separation roll Rs serving as an example of a medium separating member, and is conveyed to a sheet supply path SH1 serving as an example of a medium supply path. A recording sheet S supplied to the sheet supply path SH1 is conveyed to the registration roll Rr serving as an example of a medium conveyance timing control member by a plurality of conveying rolls Ra serving as an example of a medium conveying member. The recording sheet S conveyed to the registration roll Rr is conveyed to a sheet guide SG1 before transfer to the secondary transfer region Q4 serving as an example of a medium guide member before transfer, in accordance with the timing when the primarily transferred multi-toner image or monochrome toner image is moved to the secondary transfer region Q4. In the secondary transfer region Q4, the secondary transfer unit T2 transfers a secondary toner image on the intermediate transfer belt B onto the recording sheet S. The intermediate transfer belt B after the secondary transfer is cleaned by the belt cleaner CL2 serving as an example of the cleaning device of the intermediate transfer body, and the residual toner is removed.

The secondary transfer roller T2*b* and the belt cleaner CL2 are disposed so as to be capable of being spaced apart from and brought into contact with the intermediate transfer belt B, and are spaced apart from the intermediate transfer belt B until a non-fixed toner image of a final color is primarily transferred to the intermediate transfer belt B in a case where a color image is formed.

The recording sheet S to which a toner image has been secondarily transferred is conveyed to a fixing region Q5 by a sheet guide SG2 after transfer serving as an example of a medium guide member after transfer, and a sheet conveying belt BH serving as an example of a medium suction conveying member. The fixing region Q5 is a region where a heating roller Fh serving as an example of a heating member of a fixing device F and a pressure roller Fp serving as an example of a pressure member are brought into pressure contact with each other, and the recording sheet S that passes through the fixing region Q5 is heated and fixed by the fixing device F.

The recording sheet S on which a toner image has been fixed is conveyed to a sheet ejection path SH2 on the downstream side of the fixing region Q5 serving as an example of a medium ejection path, and is ejected to the outside from a sheet ejection port Rha serving as an example of a medium ejection port by a sheet ejection roll Rh serving as an example of a medium ejection member. The recording sheet S ejected from the sheet ejection port Rha is ejected and loaded on a sheet ejection tray TRh serving as an example of a medium ejection section.

A sheet reversing path SH3 serving as an example of a medium reversing path is connected to the sheet ejection path SH2 on the upstream side of the sheet ejection roll Rh, and a switching gate GT1 serving as an example of a conveyance destination switching member is provided at a connection between the sheet reversing path SH3 and the sheet ejection path SH2. The switching gate GT1 selectively switches the recording sheet S that has been conveyed through the sheet ejection path SH2 to either the sheet ejection roll Rh side or the sheet reversing path SH3 side.

A sheet circulation path SH4 serving as an example of a medium circulation path is connected to the sheet reversing path SH3, and a switching gate GT2 serving as an example of a second conveyance destination switching member is provided at a connection between the sheet reversing path SH3 and the sheet circulation path SH4. The switching gate GT2 allows the recording sheet S conveyed through the sheet reversing path SH3 from the switching gate GT1 to pass therethrough as it is, and sends the recording sheet S, which has been once passed and sent back, to the sheet circulation path SH4. The recording sheet S conveyed to the sheet circulation path SH4 is sent again to the secondary transfer region Q4 through the sheet supply path SH1. A sheet conveying path SH serving as an example of a medium conveying path is constituted by elements designated by reference numerals SH1 to SH4. Additionally, the sheet conveying device SU serving as an example of a medium conveying device is constituted by elements designated by reference numerals Rp, Rs, Rr, Ra, SG1, SG2, and BH.

(Description of Attachable/Detachable Body)

Figure 3:
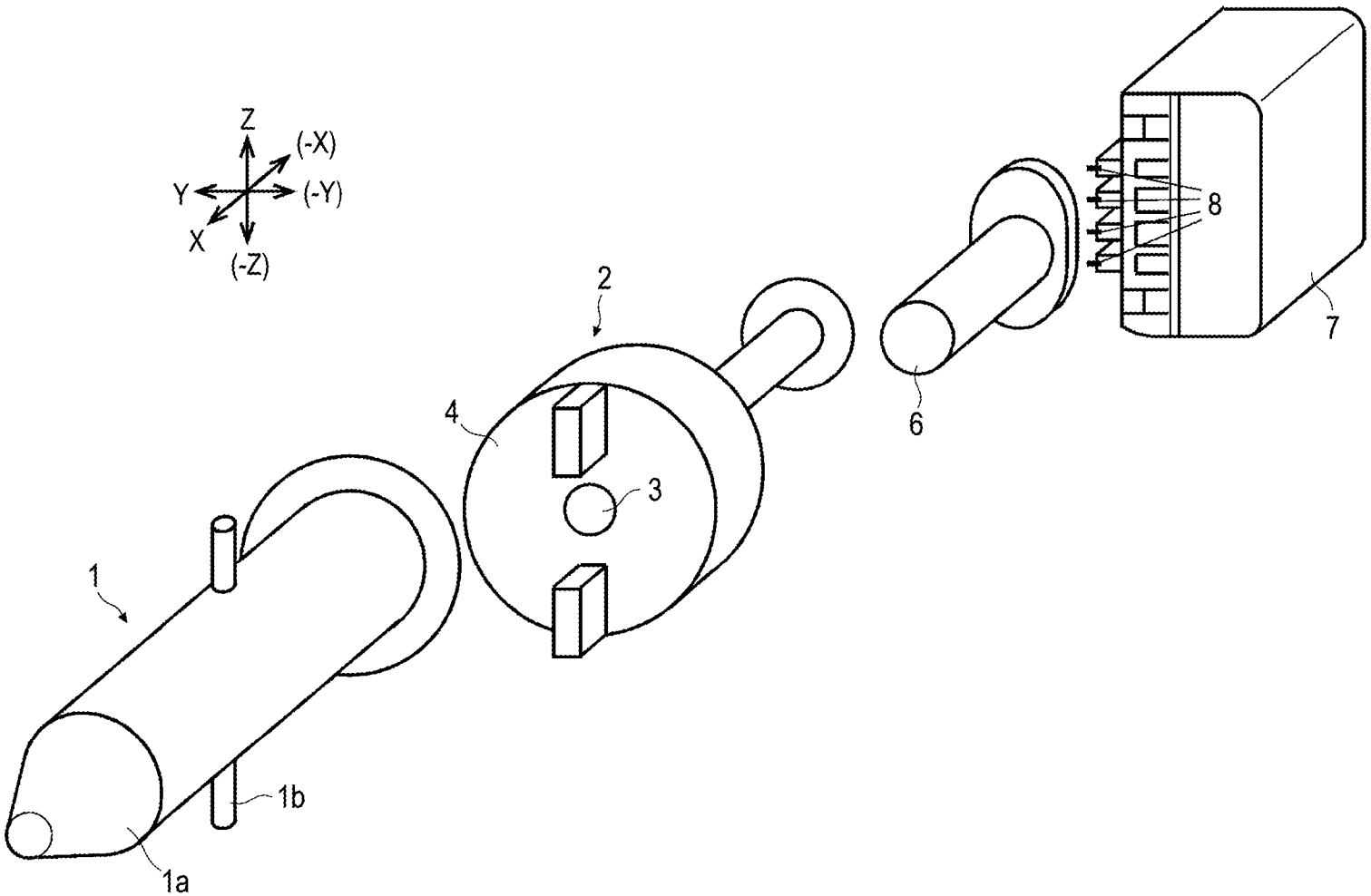
FIG. 3 is an explanatory view of the principal parts of a main body of the image forming apparatus in a state where the attachable/detachable body of Example 1 of the invention has been detached.

FIG. 3 is an explanatory view of the principal parts of the main body of the image forming apparatus in a state where the attachable/detachable body of Example 1 of the invention has been detached.

Figure 4A:
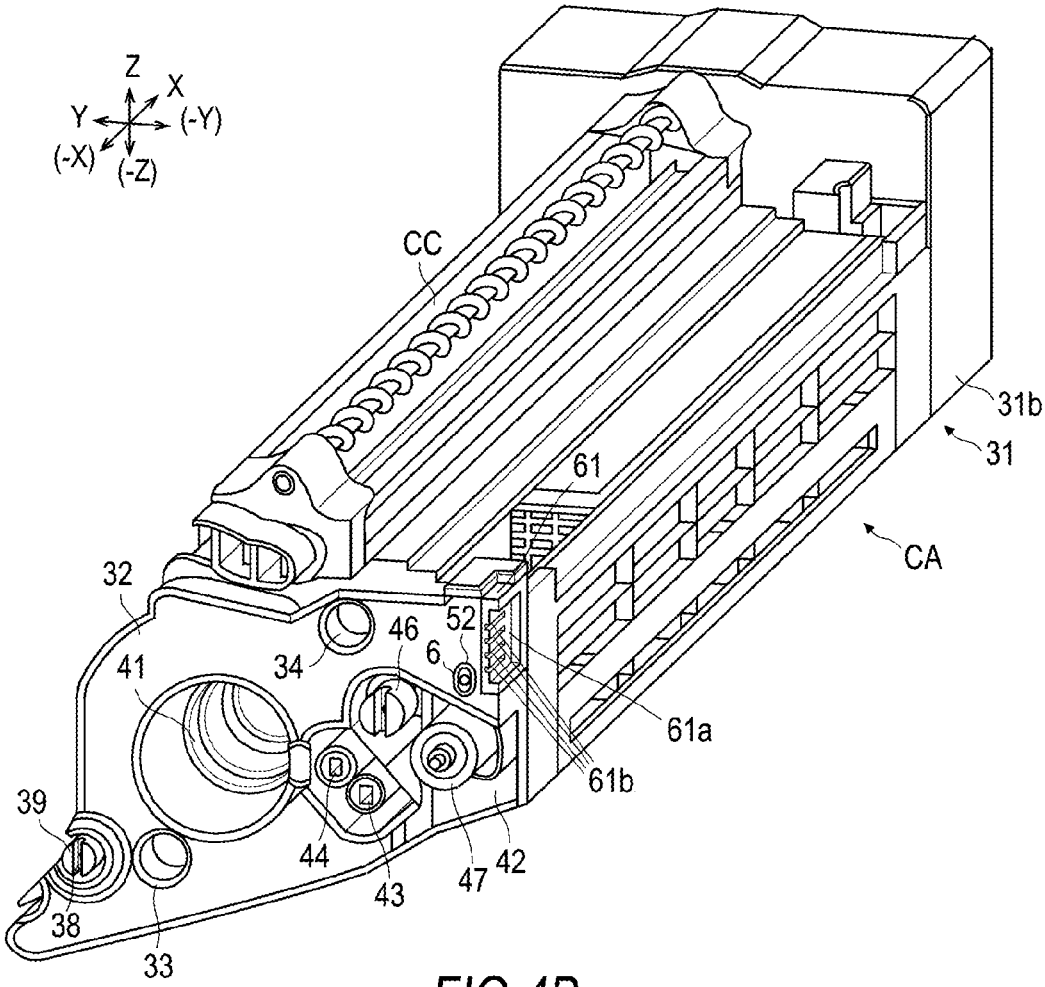
FIGS. 4A and 4B are explanatory views of the attachable/detachable body of Example 1 of the invention.
Figure 4B:
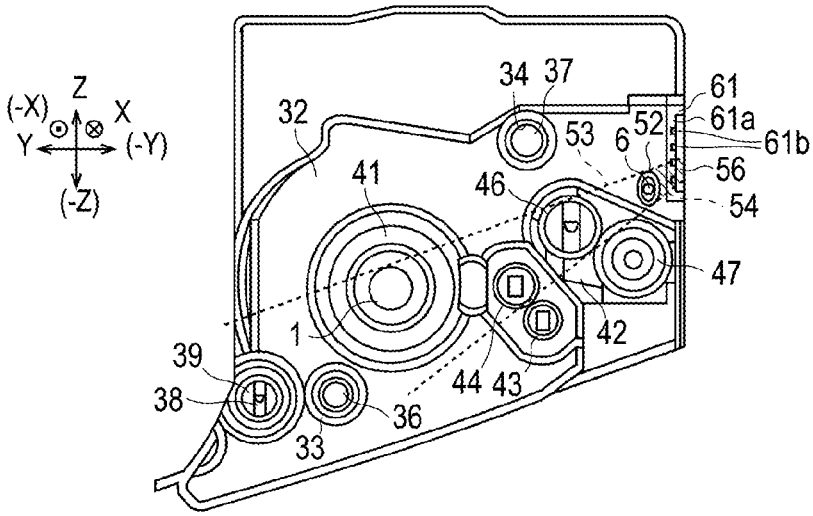

FIGS. 4A and 4B are explanatory views of the attachable/detachable body of Example 1 of the invention; FIG. 4A is an explanatory view when the attachable/detachable body is viewed from the left-diagonal upper rear, and FIG. 4B is an explanatory view when the attachable/detachable body in the state of being mounted on the main body of the image forming apparatus is viewed from the rear.

Figure 5A:
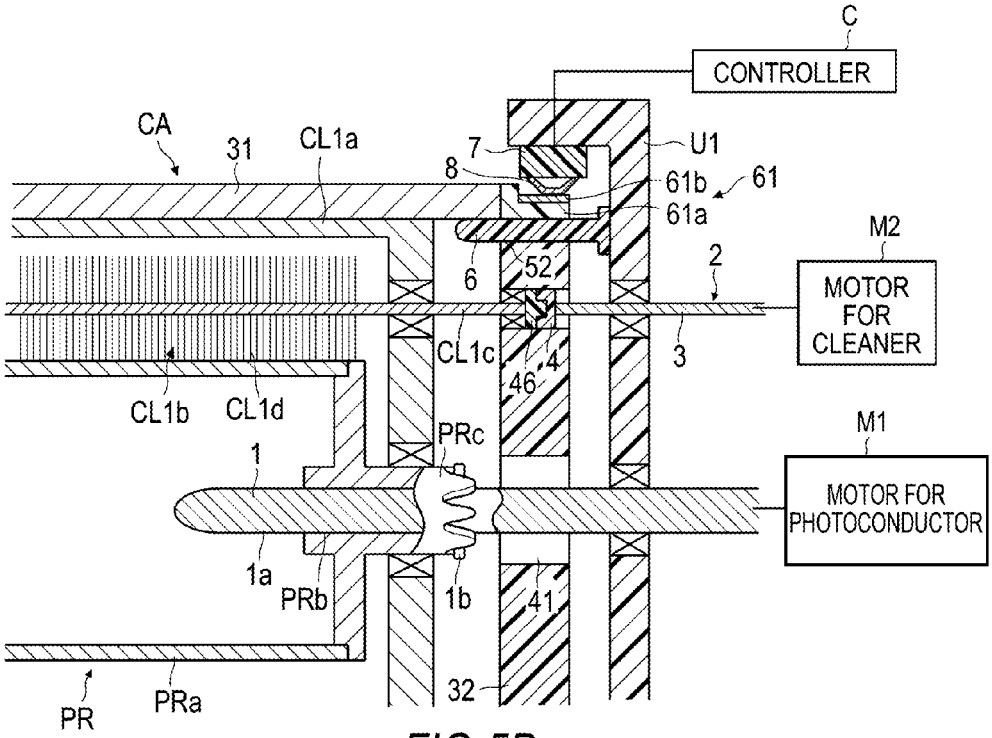
FIGS. 5A and 5B are explanatory views of the main body and attachable/detachable body of the image forming apparatus of Example 1 of the invention.
Figure 5B:
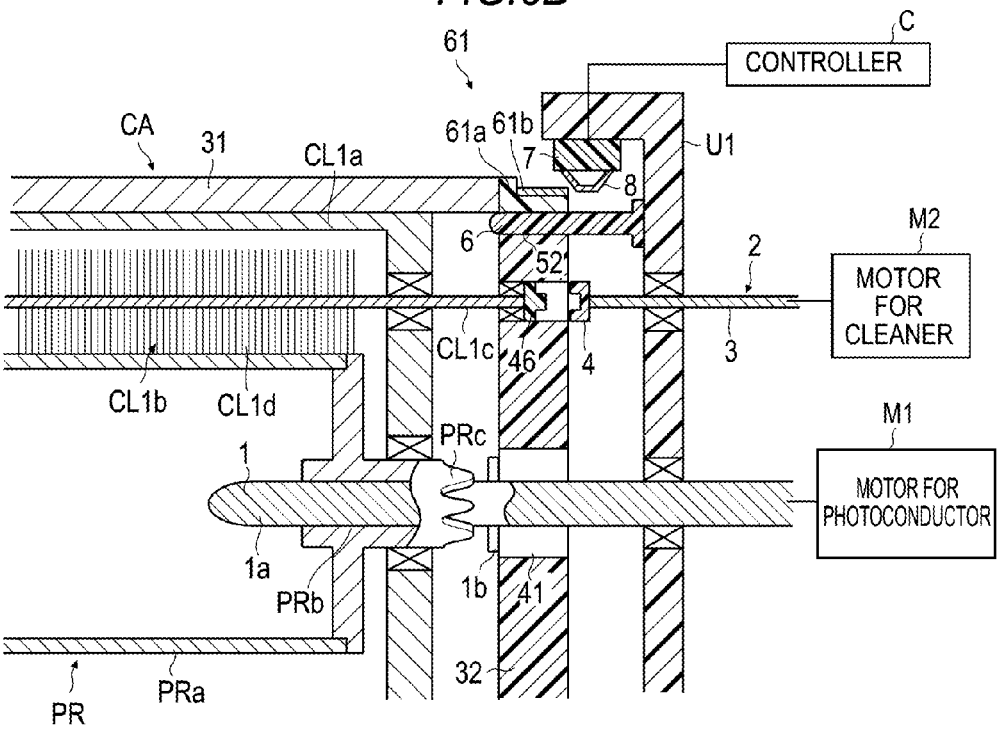

FIGS. 5A and 5B are explanatory views of the main body and attachable/detachable body of the image forming apparatus of Example 1 of the invention; FIG. 5A is an explanatory view of the principal parts in a state where the attachable/detachable body has been mounted on the main body of the image forming apparatus, and FIG. 5B is an explanatory view of the principal parts in a state where the attachable/detachable body has moved forward from the state shown in FIG. 5A.

In FIGS. 3 and 5, the space where the process cartridge CA is detached and attached is provided below the latent image forming device ROS inside the main body U1 of the copying machine of Example 1.

A driving shaft 1 serving as an example of a rotating shaft, an example of a second positioning portion, and an example of a grounding member, which protrudes forward is arranged at a position corresponding to the photoconductor drum PR, at the rear end of the space where the process cartridge CA is detached and attached. A conical guide portion la whose diameter becomes smaller as it nears the tip is formed at a tip portion of the driving shaft 1. A rod-shaped drum engaging member 1*b*, which passes through the driving shaft 1 in its radial direction and has both ends protruding from the driving shaft 1 serving as an example of a second transmission member, is supported at a rear portion of the driving shaft 1. Additionally, driving is transmitted to the driving shaft 1 from a motor M1 for a photoconductor serving as an example of a driving source. Additionally, the driving shaft 1 is formed from a metal serving as an example of a conductive member, and is electrically connected to the ground (not shown) serving as an example of a grounding portion of the copying machine provided in the main body U1 of the copying machine.

The transmission member 2 is arranged at a position corresponding to the upper right of the driving shaft 1, and the photoconductor cleaner CL1. The transmission member 2 has a transmission shaft 3 that protrudes toward the front, and a driving coupling 4 is supported by the front end of the transmission shaft 3 serving as an example of a main body of a transmission member. Additionally, driving is transmitted to the transmission shaft 3 from the motor M2 for a cleaner serving as an example of a driving source for a cleaning member.

A locating pin 6 that protrudes toward the front serving as an example of a positioning portion is arranged on the upper right of the transmission member 2. In addition, in FIG. 3, the locating pin 6 of Example 1 is arranged at a position on an extension that connects the driving shaft 1 and the transmission member 3 as seen from the front.

A main-body-side connector 7 serving as an example of a contacted portion is provided on the upper right of the locating pin 6. The main-body-side connector 7 of Example 1 is arranged at a position on an extension that connects the driving shaft 1, the transmission member 2, and the locating pin 6, as seen from the front. The main-body-side connector 7 has a connector terminal 8 serving as an example of a connected terminal that protrudes to the left, and the connector terminal 8 is made of a metallic material in the shape of a plate spring that is elastically deformable. The front end of the connector terminal 8 of Example 1 is arranged behind the front ends of the driving shaft 1, the transmission member 2, and the locating pin 6. That is, compared to the connector terminal 8, the driving shaft 1, the transmission member 2, and the locating pin 6 protrude toward the space where the process cartridge CA is detached and attached.

The main-body-side connector 7 is electrically connected to the controller C built in the main body U1 of the copying machine via a harness (not shown) serving as an example of a transmission line. In addition, the controller C of the main body U1 of the copying machine of Example 1 is constituted by a small information processing device, i.e., a so-called microcomputer, and has an I/O that performs input/output of a signal with the outside, regulation of an input/output signal level, and the like, a ROM in which a program for executing required processing, data, and the like is stored, a RAM for storing required data temporarily, an HDD, a CPU that performs processing according to a program stored in the ROM or HDD, a clock generator, and the like, and can execute a program stored in ROM, thereby realizing various functions.

In FIG. 4A, the process cartridge CA has a cartridge body 31 extending in the front-and-rear direction serving as an example of a main body of the attachable/detachable body.

The cartridge body 31 of Example 1 has the photoconductor drum PR, the photoconductor cleaner CL1, the charger CC, and the discharger JR.

In FIGS. 2 and 4A, a front cover 31*a* serving as an example of a front covering portion is supported by the front end of the cartridge body 31.

A plate-shaped rear cover 32 serving as an example of a rear supporting member is supported by a rear end portion of the cartridge body 31.

Screw openings 33 and 34 are formed at the lower right portion and an upper left end portion of the rear cover 32, and the rear cover 32 is fixed to the cartridge body 31 with screws 36 and 37.

An opening 38 for a seal roll serving as an example of an opening for a leakage preventing member is formed on the right of the screw opening 33. A driven coupling 39 serving as an example of a driven member, which is supported by a rear end portion of the seal roll SR, is housed in the opening 38 for a seal roll. When the process cartridge CA is mounted on the main body U1 of the copying machine, the driven coupling 39 meshes with the driving coupling serving as an example of a driving member (not shown) that is provided in the main body U1 of the copying machine, driving is transmitted thereto, and the seal roll SR rotates.

In FIG. 4, a hole-shaped positioned hole 41 for a photoconductor serving as an example of a second positioned portion through which the driving shaft 1 can pass is formed at a position corresponding to the driving shaft 1 on the upper left of the screw opening 33.

In FIGS. 4 and 5, the photoconductor drum PR arranged coaxially with the positioned hole 41 ahead of the positioned hole 41 is an example of a main body of an image carrier, and has a cylindrical drum body PRa extending in the front-and-rear direction serving as an example of a grounded member. An axial insertion hole PRb serving as an example of the second positioned portion that passes through the inside of the drum body in the axial direction is formed in the drum body PRa. The axial insertion hole PRb has an internal diameter corresponding to the external diameter of the driving shaft 1, and is positioned by the fitting to the driving shaft 1 in a case where the driving shaft 1 is guided and inserted by the guide portion 1*a*. In addition, the drum body PRa of Example 1 is constituted by a base made of a cylindrical metal having conductivity, which is arranged on the inner peripheral side, and a conventionally well-known photoconductor drum having a photoconductor layer that has one or more layers on the outer surface of the base. In addition, the drum body PRa of Example 1 has a function as a grounded member to which the base is grounded. Hence, in a case where the driving shaft 1 is inserted, the drum body PRa comes into contact with the driving shaft 1 and is electrically connected thereto. The rear end of the drum body PRa is formed with a grooved engaged portion PRc of the photoconductor serving as an example of a second transmitted member, which corresponds to the drum engaging member 1*b* and extends in the radial direction from the center of rotation of the drum body PRa. When the drum engaging member 1*b* fits into the engaged portion PRc of the photoconductor as shown in FIG. 5A, rotation can be transmitted from the driving shaft 1 to the photoconductor drum PR.

An opening 42 of a shape obtained by cutting away the rear cover 32 from the left end to the central portion in the right-and-left direction is formed on the left of the positioned hole 41 for a photoconductor so as to correspond to photoconductor cleaner CL1. A connector 43 for a discharger serving as an example of a power-fed portion of the discharger is arranged at a lower right portion of the opening 42. The connector 43 for a discharger is electrically connected to the discharger JR via a wiring line for a discharger (not shown). When the process cartridge CA is mounted on the main body U1 of the copying machine, a power-fed connector 43 of the discharger fits to a connector for power feed (not shown) which is provided in the main body U1 of the copying machine, the discharger JR and the electric circuit E are electrically connected to each other JR, and power feed to the discharger JR is performed.

A connector 44 for a cleaner serving as an example of a power-fed portion for a cleaning member is arranged on the upper right of the power-fed connector 43 of the discharger. The connector 44 for a cleaner is electrically connected to the shaft portion CL1*c* of the cleaner via a wiring line for a cleaning member (not shown). When the process cartridge CA is mounted on the main body U1 of the copying machine, the connector 44 for a cleaner fits to the connector for power feed (not shown) which is provided in the main body U1 of the copying machine, and the electric circuit E and the cleaner brush CL1*b* are electrically connected to each other via the shaft portion CL1*c* of the cleaner, thereby applying voltage which electrically adsorbs the toner on the cleaner brush CL1*b*.

The shaft portion CL1*c* of the cleaner is supported on the upper left of the power-fed connector 44 for a cleaner, and a coupling 46 of the cleaner is supported by a rear end portion of the shaft portion CL1*c* of the cleaner serving as an example of a transmitted member. Additionally, the coupling 46 of the cleaner of Example 1 is arranged corresponding to the driving coupling 4. When the process cartridge CA is mounted on the main body Ul of the copying machine, the coupling 46 meshes with the driving coupling 4 and has driving transmitted therefrom, so that rotation can be transmitted to the photoconductor cleaner CL1.

A tubular residual developer conveying cylinder 47 serving as an example of a conveying portion that extends rearward from the cleaner container CL1*a* is arranged on the lower left of the coupling 46 of the cleaner. A rear end portion of the discharge auger CL1*f* of the photoconductor cleaner CL1 is housed in the residual developer conveying cylinder 47, and a discharge port (not shown) is formed at the rear end of the residual developer conveying cylinder 47.

A gear (not shown) is supported by a front end of the discharge auger CL1*f*, and meshes with a gear (not shown) supported by the front end of the shaft portion CL1*c* of the cleaner, so that driving can be transmitted. Accordingly, when driving is transmitted to the cleaner brush CL1*b* from the driving coupling 4, and the discharge auger CL1*f* rotates, the developer within the cleaner container CL1*a* is conveyed rearward, and is discharged from the discharge port of the residual developer conveying cylinder 47. The discharged developer is recovered to a recovery container (not shown) that is provided in the main body U1 of the copying machine and is connected to the discharge port.

A long-hole-shaped positioned hole 52 extending in the up-and-down direction serving as an example of a positioned portion corresponding to the locating pin 6 is formed on the upper left of the coupling 46 of the cleaner. In the long-hole-shaped positioned hole 52 of Example 1, the internal diameter that is a shorter diameter is formed corresponding to the external diameter of the locating pin 6. In a case where the process cartridge CA is mounted on the main body U1 of the copying machine and the locating pin 6 is inserted into the positioned hole 52, the position of the positioned hole 52 in the right-and-left direction is positioned with the locating pin 6.

In addition, in FIG. 4B, when the positioned hole 41 for a photoconductor, the coupling 46 of the cleaner, and the positioned hole 52 in Example 1 are seen from the rear, a portion of the positioned hole 41 for a photoconductor is arranged in the state of being included in a region 56 pinched by extensions of two common tangential lines 53 and 54 of a circle of the external diameter of the positioned hole 52 and a circle of the external diameter of the coupling 46 of the cleaner.

A memory member 61, i.e., a so-called CRUM (CRUM: Customer Replaceable Unit Memory) serving as an example of a contacting portion is supported at a position corresponding to the main-body-side connector 7 of the upper left end of the rear cover 32 at an upper left position of the positioned hole 52. In addition, information on lifespan, such as the cumulative number of rotations of the photoconductor drum PR and the cumulative number of printed sheets, is stored in the memory member 61 of Example 1. Additionally, in FIG. 4B, the memory member 61 of Example 1 is arranged at a position where a portion is included in the region 56 pinched by the extensions 53 and 54 of the two common tangential lines, as seen from the rear.

In addition, the memory member 61 of Example 1 has a substrate 61*a* made of epoxy resin serving as an example of a resin material, and conventionally well-known storage element and electric circuit (not shown) are arranged on the substrate 61*a*. In the memory member 61, a connector 61*b* of the CRUM serving as an example of a terminal for connection that extends in the front-and-rear direction is supported at a position corresponding to the connector terminal 8 on the left face of the substrate 61*a*, and the connector 61*b* of the CRUM is electrically connected to the storage element via the electric circuit.

The connector 61*b* of the CRUM is formed such that gold serving as an example of a conductive metallic material is plated on the substrate 61*a*. That is, so-called gold plating is performed. In addition, in Example 1, although epoxy resin and gold has been illustrated as the material of substrate 61*a* and the connector 61*b* of the CRUM, the material is not limited thereto, and can be arbitrarily changed according to design, specification, or the like.

When the process cartridge CA is mounted on the main body U1 of the copying machine, the connector 61*b* of the CRUM is connected in a state where the connector terminal 8 of the main-body-side connector 7 is elastically deformed and biased. Hence, the memory member 61 and the controller C are electrically connected to each other, so that transmission and reception of information becomes possible.

Additionally, when the process cartridge CA is mounted on the main body U1 of the copying machine, the connector 61*b* of the CRUM of Example 1 is configured so as to contact the connector terminal 8 after the driving shaft 1 and the locating pin 6 that have protruded more forward than the main-body-side connector 8 are fitted into the second positioned hole 41 and the positioned hole 52.

That is, respective members, such as the driving shaft 1, the locating pin 6, the second positioned hole 41, and the positioned hole 52, are arranged so that the connector 61*b* of the CRUM and the main-body-side connector 8 come into contact with each other after the process cartridge CA is positioned.

OPERATION OF EXAMPLE 1

In the image forming apparatus U of Example 1 including the above configuration, in the main body U1 of the copying machine in the state where the process cartridge CA is mounted, when a job serving as an example of an image formation operation is started, the motor (not shown) drives to rotationally driven the transmission member 2. Then, when the rotational driving of the transmission member 2 is transmitted, driving is transmitted to the coupling 46 of the cleaner on the side of the process cartridge CA from the driving coupling 4 on the side of the main body U1 of the copying machine, and the cleaner brush CL1*b* and the discharge auger CL1*f* are rotationally driven.

Here, a manufacturing error, a gap at the time of mounting, or the like exists in the driving coupling 4 and the coupling 46 of the cleaner, and when driving is transmitted to the coupling 46 of the cleaner from the driving coupling 4, a periodic vibration may be generated with rotation.

When the periodic vibration is generated between the driving coupling 4 and the coupling 46 of the cleaner, there is a concern that the vibration is transmitted to the cartridge body 31, and the main body of the cartridge 31 may vibrate.

Figure 6:
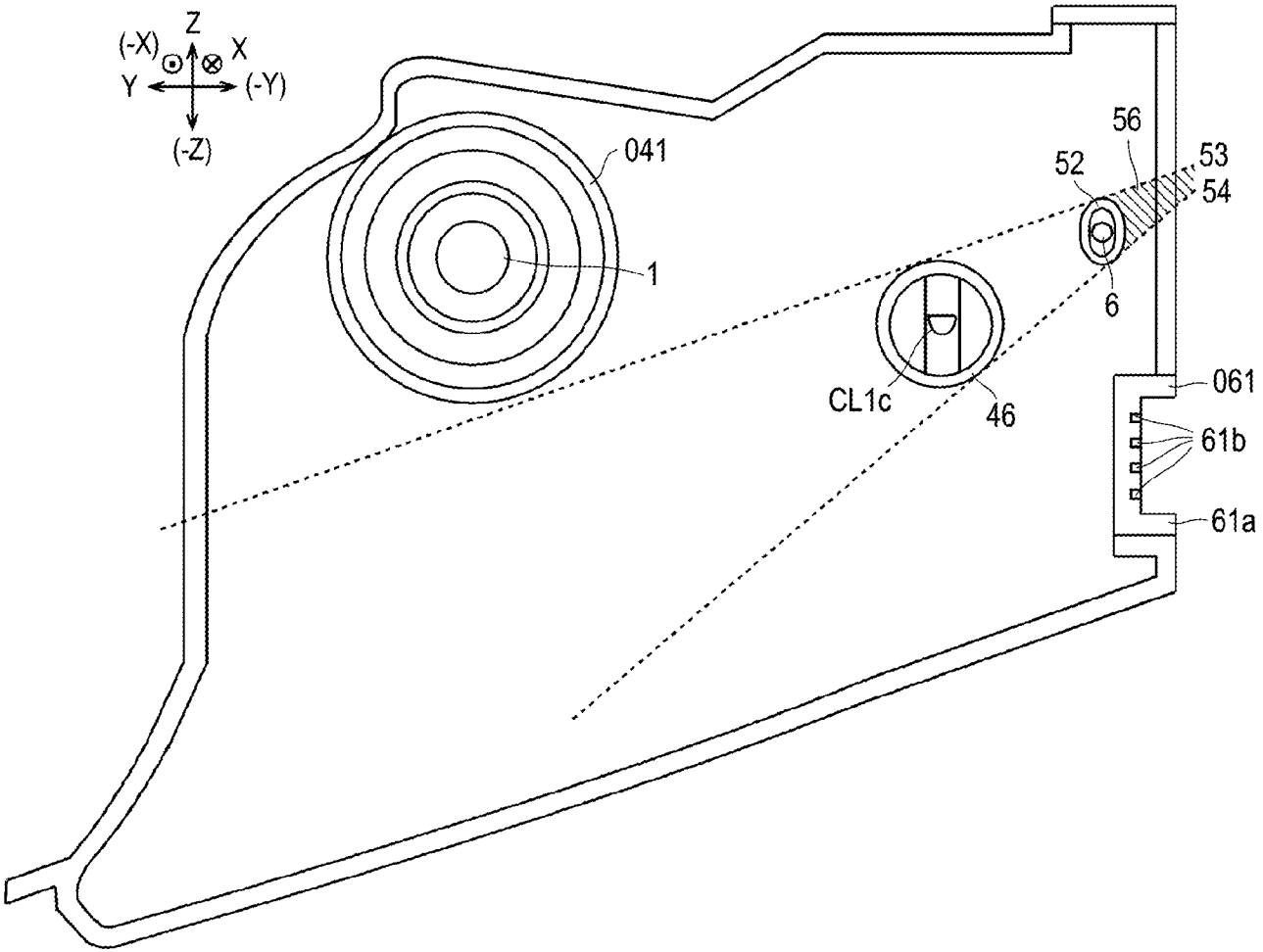
FIG. 6 is an explanatory view of the attachable/detachable body of the invention of which at least a portion is not arranged on an extension of a straight line that a memory member and a second positioned portion connect a transmitted member and a positioned portion.

FIG. 6 is an explanatory view of the attachable/detachable body of which at least a portion is not arranged on an extension of a straight line that the memory member and the second positioned portion connect the transmitted member and the positioned portion.

Here, a configuration in which the positioned hole 52 is not arranged between the coupling 46 of the cleaner, and the memory member 61, i.e., as shown in FIG. 6, a case where a memory member 061 is not arranged in the region 56 pinched by the extensions of the two common tangential lines 53 and 54 of the coupling 46 of the cleaner and the positioned hole 52, is considered. When vibration is generated in the coupling 46 of the cleaner shown in FIG. 6, the vibration is directly transmitted to the memory member 061 via the cartridge body 31. Hence, there is a concern that the memory member 061 and the main-body-side connector 7 maybe rubbed with the vibration of the memory member 061, the connector terminal 8 and the connector 61*b* of the CRUM may be worn out, poor contact may occur between the connector terminal 8 and the connector 61*b* of the CRUM, and poor conduction or poor transmission and reception of signals may occur between the controller C and the memory member 061.

On the other hand, in Example 1, the positioned hole 52 is arranged between the coupling 46 of the cleaner, and the memory member 61 and is positioned by the locating pin 6. In the positioned hole 52 that is fixed, the vibration from the coupling 46 of the cleaner is attenuated, and the vibration to be transmitted to the memory member 61 arranged on the extension of the coupling 46 of the cleaner and the positioned hole 52 is reduced.

Accordingly, compared to the configuration in which the memory member 061 is not arranged in the region 56 pinched by the extensions of the two common tangential lines 53 and 54 of the coupling 46 of the cleaner, and the positioned hole 52, the worn-out of the connector terminal 8 or the connector 61*b* of the CRUM is reduced, poor connection between the connector terminal 8 and the connector 61*b* of the CRUM is reduced, and occurrence of poor conduction or poor transmission and reception of signals is reduced between the controller C and the memory member 61.

Particularly, as in Example 1, in the configuration where the connector 61*b* of the CRUM and the main-body-side connector that are exposed to the side with respect to the attachment/detachment direction of the process cartridge CA are electrically connected to each other, a connector portion is easily influenced when the main body of the cartridge 31 has vibrated compared to a connecting structure where one is electrically connected to the other in the state of being fitted and connected to each other, for example, the configuration of a modular jack or the like. In order to cope with this, in the configuration of Example 1, the influence of vibration on the connector is reduced, and even in a case where the connector is exposed to the side, a problem accompanying adverse effect of the vibration hardly occurs.

Additionally, a configuration in which the coupling 46 of the cleaner is not arranged between the second positioned hole 41 and the positioned hole 52, i.e., as shown in FIG. 6, a case where a second positioned hole 041 is not arranged in the region 56 pinched by the extensions of the two common tangential lines 53 and 54 of the coupling 46 of the cleaner and the positioned hole 52 is considered.

When vibration is generated in the coupling 46 of the cleaner shown in FIG. 6, vibration is transmitted to the opposite side of the positioned hole 52 without attenuation from the relationship between the coupling 46 of the cleaner and the positioned hole 52, and vibration is transmitted to the opposite side of the second positioned hole 041 without attenuation from the relationship between the coupling 46 of the cleaner and the second positioned hole 041. Hence, the influence that the vibration from the coupling 46 of the cleaner has on the process cartridge CA easily increases as a whole.

On the other hand, in Example 1, the coupling 46 of the cleaner is arranged in the region 56, and is in the state of being fixed by the positioned holes 41 and 52, on both sides of the coupling 46 of the cleaner. Hence, as a whole, the vibration from the coupling 46 of the cleaner is suppressed by the positioned holes 41 and 52 on both sides, and the influence exerted on the process cartridge CA becomes restrictive compared to the case shown in FIG. 6.

Here, generally, compared to the cleaner brush CL1*b*, the torque that rotates the large-sized and heavy photoconductor drum PR is set to be great than the torque that acts on the coupling 46 of the cleaner. In a case where vibration is generated with the rotation of the photoconductor drum PR, the influence of the vibration increases easily. In a configuration in which the second positioned portion 41 is not positioned near the periphery of the photoconductor drum PR, there is a concern that an adverse effect of vibration generated in the photoconductor drum PR onto the process cartridge CA may increase.

On the other hand, in Example 1, the second positioned portion 41 is positioned so as to surround the outer periphery of the driving shaft 1, the influence of vibration generated in the coupling 46 of the cleaner on the process cartridge CA is suppressed by the second positioned portion 41, and the influence of vibration generated in the photoconductor drum PR with large torque is suppressed. Hence, compared to the configuration in which the second positioned portion 41 is not positioned near the periphery of the photoconductor drum PR, generation of a poor image of a striped pattern, i.e., so-called banding, which is caused due to the vibration between the photoconductor drum PR and the developing device G are reduced.

Additionally, in Example 1, when the process cartridge CA is mounted on the main body U1 of the copying machine, respective members, such as the driving shaft 1, the locating pin 6, the second positioned hole 41, and the positioned hole 52, are arranged so that the connector 61*b* of the CRUM and the main-body-side connector 8 come into contact with each other after the process cartridge CA is positioned. Accordingly, when the process cartridge CA is mounted, first, the second positioned hole 41 and the positioned hole 52 fit to the driving shaft 1 and the locating pin 6 halfway and are positioned, and then, the connector 61*b* of the CRUM and the main-body-side connector 8 come into contact with each other. Hence, compared to a case where the connector 61*b* of the CRUM and the main-body-side connector 8 come into contact with each other before being positioned, when the connector 61*b* of the CRUM and the main-body-side connector 8 come into contact with each other, the relative positional deviation between the connector 61*b* of the CRUM and the main-body-side connector 8 is reduced, and it is reduced that the connector 61*b* of the CRUM and the main-body-side connector 8 are rubbed and the connector is scraped off.

(Modifications)

Although the example of invention has been described in detail, the invention is not limited to the above example, but various modifications of the invention can be made within the scope of the invention set forth in claims. Modifications (H01) to (H09) of the invention are illustrated below.

(H01) Although the image forming apparatus U serving as an example of an image forming apparatus has been illustrated in the above example, the invention is not limited thereto. For example, the invention can also be configured by, for example, a printer, a facsimile, or a complex machine having all or plural functions thereof.

(H02) Although the configuration in which four color developers are used for the image forming apparatus U has been illustrated in the above example, the invention is not limited thereto this. For example, the invention can also be applied to a monochromatic image forming apparatus, and a multicolor image forming apparatus of five or more colors or three colors or less.

(H03) Although the configuration in which one set of the positioned hole 52 and the locating pin 6 are arranged has been illustrated in the above example, the invention is not limited thereto. The number of positioned portions and positioning portions can be arbitrarily changed. It is also possible to adopt a configuration in which two or more sets of positioned portions and positioning portions are arranged. Additionally, the shapes of a positioning portion and a positioned portion can be arbitrarily changed according to design, such as using a pin-shaped projection member as the positioned portion and using a hole-shaped positioning hole as the positioning portion.

(H04) Although the configuration in which the coupling 46 of the cleaner serving as an example of a transmitted member that drives the cleaner brush CL1*b* is arranged has been illustrated in the above example, the invention is not limited thereto. For example, it is also possible to use a transmitted member that drives the discharge auger CL1*f* and use a transmitted member that moves other driven members, instead of the coupling 46 of the cleaner.

(H05) Although the configuration in which the positioned hole 41 for a photoconductor is positioned so as to surround the periphery of the driving shaft 1 has been illustrated in the above example, the invention is not limited thereto. For example, it is also possible to arrange the positioned hole 41 for a photoconductor at a position deviated from the driving shaft 1. In this case, as the configuration for positioning, it is also possible to adopt a configuration in which positioning is performed by one or more sets of pin-shaped positioning portions and hole-shaped positioned portions, instead of the driving shaft 1 and the positioned hole 41 for a photoconductor. Additionally, it is also possible to adopt a configuration in which one or more sets of positioning portions and positioned portions are added near the driving shaft 1 and the positioned hole 41 for a photoconductor in Example 1. Additionally, although the configuration in which positioning is performed at the outer periphery of the driving shaft 1 is desirable, it is also possible to adopt a configuration in which positioning is not performed at the outer periphery of the driving shaft 1, and the second positioning portion and the second positioned portion are omitted.

(H06) Although the configuration in which the memory member 61 is arranged in a state where a portion thereof is included the region 56*a* of the region 56 on the side of the positioned hole 52 as seen from the rear has been illustrated in the above example, the invention is not limited thereto. It is also possible to adopt a configuration in which the positions of the positioned hole 52, the locating pin 6, the memory member 61, and the coupling 46 of the cleaner are changed within a range where a portion of the memory member 61 is included in the region 56, or a configuration in which, as seen from the rear, the memory member 61 is arranged in a state where the whole memory member 61 is included in the region 56*a*.

(H07) Although the memory member 61 that stores information on the attachable/detachable body, and the corresponding main-body-side connector 7 have been illustrated in the example, the invention is not limited thereto. For example, instead of the memory member 61 and the main-body-side connector 7, it is also possible to provide the region 56*a* with a connector 44' that discharges or charges the cleaner, and to provide the main body U1 of the copying machine with a connector capable of contacting the connector 44'. Otherwise, it is also possible to adopt a configuration in which both the memory member 61 and the connector 44' for a cleaner are arranged in the region 56*a*, or a contacting portion formed from a metal serving as an example of a conductive member that may be rubbed and worn out with the vibration of the process cartridge CA is arranged.

(H08) although the process cartridge CA serving as an example of the attachable/detachable body having photoconductor drum PR, charger CC, and photoconductor cleaner CL1 has been illustrated in the example, the invention is not limited thereto. For example, it is also possible to adopt a configuration in which the charger CC is not provided, and a configuration in which a member, such as a developing device, is added besides the photoconductor drum PR, the charger CC, and the photoconductor cleaner CL1.

(H09) Although the process cartridge CA serving as an example of the attachable/detachable body has been illustrated in the example, the invention is not limited thereto. For example, in a belt module serving as an example of an attachable/detachable body having an endless belt that faces a photoconductor drum, a driving roll that rotates the belt, and a transfer member that is arranged inside the belt to transfer a image on the surface of a photoconductor drum to the belt side, the invention can also be applied to a configuration that has the driving roll serving as an example of a driven member, and a power feed connector serving as an example of a contacting portion that supplies a transfer voltage to the transfer member. Additionally, in a toner cartridge serving as an example of an attachable/detachable body in which a developer to be supplied to a developing unit is stored, the invention can also be applied to a configuration that has a developer conveying member within a toner cartridge serving as an example of a driven member, a connector serving as an example of a contacting portion that is electrically connected to a memory member that stores whether or not the developer within the toner cartridge is empty, and a detecting member that detects the concentration of the developer. Moreover, in a sheet feed tray serving as an example of an attachable/detachable body in which a medium on which an image is to be recorded is housed, the invention can also be applied to a configuration that has an elevating mechanism serving as an example of a driven member that elevates a medium, and a connector serving as an example of a contacting portion that is electrically connected to a sensor that detects the size of the housed medium. In addition, the invention can be applied to an attachable/detachable body that has driven members, such as a roll and a conveying member, and a contacting portion for performing power feed, transmission and reception of signals, and the like.

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best exampling the principles of the invention and its practical applications, thereby enabling others skilled in the art to understand the invention for various embodiments and with the various modifications as are suited to the particular use contemplated. It is intended that the scope of the invention is defined by the following claims and their equivalents.

What is claimed is:

1. An attachable/detachable body comprising:

a main body of the attachable/detachable body supported to be attachable to and detachable from a main body of an image forming apparatus;

a positioned portion provided at the main body of the attachable/detachable body, and positioned at a positioning portion provided at the main body of the image forming apparatus in response to the main body of the attachable/detachable body being mounted on the main body of the image forming apparatus;

a transmitted member provided at the main body of the attachable/detachable body, and connected to a transmission member provided at the main body of the image forming apparatus to transmit a drive thereto in response to the main body of the attachable/detachable body being mounted on the main body of the image forming apparatus, the transmitted member transmitting the drive to a driven member provided at the main body of the attachable/detachable body; and a contacting portion that is provided at the main body of the attachable/detachable body, and comes into contact with a contacted portion that is provided at the main body of the image forming apparatus to be connected electrically thereto, wherein in response to the main body of the attachable/detachable body being mounted on the main body of the image forming apparatus, the positioned portion is arranged between the contacting portion and the transmitted member, and at least a portion of the contacting portion is arranged on an extension of a straight line that passes through the positioned portion and the transmitted member, and wherein a line through the positioned portion, the transmitted member and the contacting portion is a line perpendicular to an axis direction of the transmitted member.

2. The attachable/detachable body according to claim 1, wherein the contacting portion is included in a memory that stores information on the attachable/detachable body, and the contacted portion is included in a read-out member that reads out the information stored in the memory and comes in contact with the memory and the read-out member to connect electrically thereof when the main body of the attachable/detachable body is mounted on the main body of the image forming apparatus.

3. The attachable/detachable body according to claim 1, wherein the contacting portion that is provided on the upstream side of the positioning portion in a mounting direction in which the main body of the attachable/detachable body is mounted on the main body of the image forming apparatus, the contacting portion comes into contact with the contacted portion after the positioned portion is positioned, when the main body of the attachable/detachable body is mounted on the main body of the image forming apparatus.

4. The attachable/detachable body according to claim 1, further comprising:

an image carrier that carries an image on a surface thereof; and a cleaning member that cleans the surface of the image carrier, wherein the driven member is included in the cleaning member, and rotates by the drive transmitted thereto by the transmitted member.

5. The attachable/detachable body according to claim 1, further comprising:

a second positioned portion that is arranged on the opposite side of the positioned portion with the transmitted member therebetween and has at least a portion arranged on an extension of a straight line that passes through the transmitted member and the positioned portion, the second positioned portion being positioned at a second positioning portion provided at the main body of the image forming apparatus when the main body of the attachable/detachable body is mounted on the main body of the image forming apparatus.

6. The attachable/detachable body according to claim 5, further comprising:

an image carrier that carries an image on a surface thereof; and a second transmitted member that is connected to a second transmission member supported by the rotating shaft to transmit the drive to the image carrier when the main body of the attachable/detachable body is mounted on the main body of the image forming apparatus, wherein the second positioned portion is provided at the image carrier, and has a hole shape extending in an axial direction of the image carrier, the second positioned portion being fitted by the second positioning portion included in a rotating shaft rotatably supported by the main body of the image forming apparatus, to position the main body of the attachable/detachable body when the main body of the attachable/detachable body is mounted on the main body of the image forming apparatus.

7. The attachable/detachable body according to claim 6, further comprising:

a grounded member that is provided on an inner peripheral surface of the second positioned portion to be capable of carrying current, wherein the grounded member is electrically connected to the second positioning portion that has a grounded grounding member, which ground the grounded member, on an outer peripheral surface thereof, to be grounded when the main body of the attachable/detachable body is mounted on the main body of the image forming apparatus.

8. An image forming apparatus comprising:

an attachable/detachable body including:

a main body of the attachable/detachable body supported to be attachable to and detachable from a main body of an image forming apparatus;

a positioned portion provided at the main body of the attachable/detachable body, and positioned at a positioning portion provided at the main body of the image forming apparatus in response to the main body of the attachable/detachable body being mounted on the main body of the image forming apparatus;

a transmitted member provided at the main body of the attachable/detachable body, and connected to a transmission member provided at the main body of the image forming apparatus to transmit a drive thereto, in response to the main body of the attachable/detachable body being mounted on the main body of the image forming apparatus, the transmitted member transmitting the drive to a driven member provided at the main body of the attachable/detachable body;

a contacting portion provided at the main body of the attachable/detachable body, and comes into contact with a contacted portion that is provided at the main body of the image forming apparatus to be connected electrically thereto, wherein in response to the main body of the attachable/detachable body being mounted on the main body of the image forming apparatus, the positioned portion is arranged between the contacting portion and the transmitted member, and at least a portion of the contacting portion is arranged on an extension of a straight line that passes through the positioned portion and the transmitted member, and wherein a line through the positioned portion, the transmitted member and the contacting portion is a line perpendicular to an axis direction of the transmitted member:

an image carrier that carries an image on a surface thereof; and a developing device that develops a latent image on the surface of the image carrier as a visible image;

a transfer unit that transfers the visible image developed by the developing device to a medium; and a fixing unit that fixes the visible image transferred to the medium.

9. The attachable/detachable body according to claim 1, wherein the positioned portion is arranged between the contacting portion and an entirety of the transmitted member.

* * * * *